United States Patent [19]

Kobler

[11] Patent Number: 4,648,672

[45] Date of Patent: Mar. 10, 1987

[54] WIRE SEAL

[75] Inventor: Robert J. Kobler, Harrisburg, Pa.

[73] Assignee: AMP Incorporated, Harrisburg, Pa.

[21] Appl. No.: 735,886

[22] Filed: May 17, 1985

[51] Int. Cl.[4] ..... H01R 4/00

[52] U.S. Cl. ..... 339/94 M

[58] Field of Search ..... 339/94, 60, 213 R, 103 R, 339/103 M

[56] References Cited

U.S. PATENT DOCUMENTS

| | | | |
|---|---|---|---|
| 3,167,374 | 1/1965 | Healy | 339/103 R |
| 3,528,051 | 9/1970 | Toedtman et al. | 339/213 R |
| 3,629,792 | 12/1971 | Dorrell | 339/60 M |
| 4,150,866 | 4/1979 | Snyder et al. | 339/94 M |
| 4,283,597 | 11/1981 | Cooper, Jr. | 339/213 R |
| 4,460,227 | 7/1984 | Ball | 339/94 M |

FOREIGN PATENT DOCUMENTS 1229216 4/1971 United Kingdom .

*Primary Examiner*—Gil Weidenfeld
*Assistant Examiner*—David L. Pirlot
*Attorney, Agent, or Firm*—Anton P. Ness

[57] ABSTRACT

An elastomeric wire seal for an individual terminated electrical conductor has a transverse body section, a sleeve-like outer section extending forwardly therefrom and a tube-like inner section extending forwardly from the body section coaxially within the outer section and spaced radially therefrom by an annular gap. A profiled bore extends through the body section and the inner section through which the terminated conductor extends. A plurality of annular ridges along the profiled bore sealingly engages the conductor which deforms them outwardly such that the inner section bulges into the annular gap between the inner and outer wire seal sections. The outer section sealingly engages sidewalls of the terminal-receiving cavity of the housing. Each wire seal can receive conductors of several adjacent wire sizes.

12 Claims, 5 Drawing Figures

WIRE SEAL

FIELD OF THE INVENTION

The invention relates to the field of electrical connectors and more particularly to wire seals for electrical connectors.

BACKGROUND OF THE INVENTION

Electrical connectors are known which receive in terminal receiving cavities thereof one or more electrical conductors having terminals terminated on ends thereof, which terminals electrically engage mating terminals in a corresponding electrical connector. Wire seals are known which are disposed around each electrical conductor at the rearward end of the connector to provide a sealing engagement between the conductor and the connector housing. Each wire seal is disposed in an enlarged rearward section of a terminal-receiving cavity of the connector housing, has a rearward portion in interference fit with the sidewalls of the rearward cavity section, and also has a forward portion which engages the conductor in interference fit therearound, such as is disclosed in U.S. Pat. No. 4,150,866.

It is desirable to provide a wire seal which engages a conductor at two or more locations for improved sealing, thus providing redundant sealing to minimize the possibility of improper sealing due to the possible tearing of the wire seal at one of the locations during insertion of a terminated conductor therethrough.

It is also desirable to provide the several locations for sealing engagement with a conductor axially proximate to the locations of sealing engagement of the wire seals with the sidewalls of the rearward cavity section of the housing, but radially separated therefrom such that force is substantially not transmitted by the wire seal portion engaging the conductor to the wire seal portion engaging the cavity sidewalls.

SUMMARY OF THE INVENTION

The wire seal of the present invention is made of a relatively incompressible elastomeric composition and has an outer, housing-engaging section extending forwardly from a transverse body section having an annular stop section therearound, providing sealing engagement with an enlarged rearward section of a terminal-receiving cavity of a housing. Extending forwardly from the transverse body section, and substantially coaxially within the outer, housing-engaging section, is a conductor-engaging section having a profiled bore extending therethrough to receive a conductor having a terminal terminated on the end thereof. An annular gap of preselected radial thickness is disposed between the outer, housing-engaging seal section and the inner, conductor-engaging section therewithin, axially forwardly of the transverse body section.

The profiled bore extending through the wire seal of the present invention has two or preferably three radially inward ridges to provide a plurality of distinct locations of sealing engagement with a terminated conductor extending therethrough in interference fit at least with the ridges, for redundant sealing. Each wire seal of the present invention can accommodate conductors of several adjacent wire sizes. Expansion of the conductor-engaging section of the wire seal especially by a larger diameter conductor, or the terminal on a conductor, can occur without exerting radially outward pressure of the outer, housing-engaging section, and without insertion being prohibitively restricted by the sides of the wire seal being tightly compressed against the cavity sidewalls as a result thereof.

DETAILED DESCRIPTION OF THE PREFERRED EMBODIMENT

Figure 1:
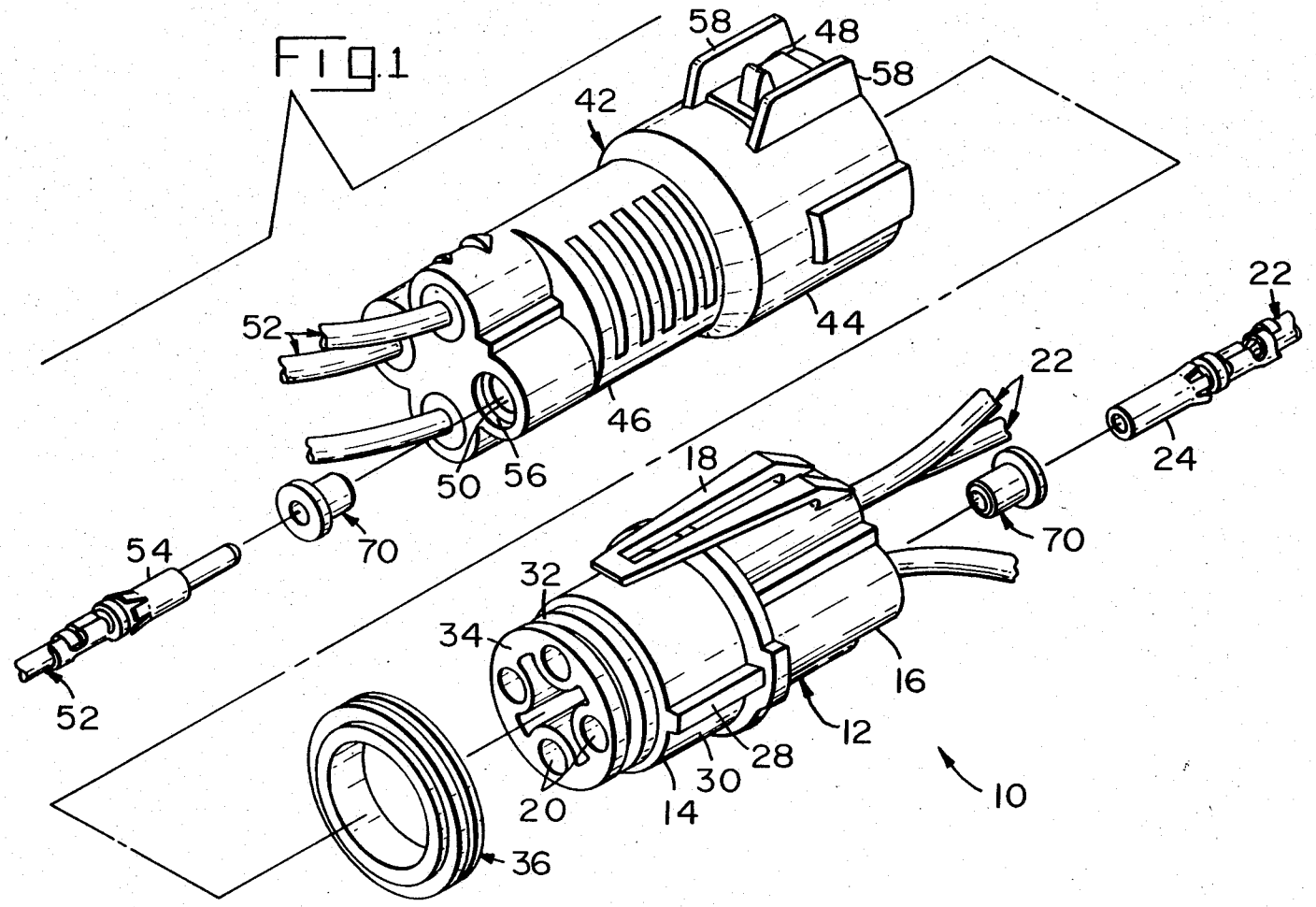
FIG. 1 is a perspective view of a connector assembly with the wire seals and terminated conductors exploded from the mating connector housings.

FIG. 1 illustrates a connector assembly 10 with which the wire seal 70 of the present invention is used. A first connector housing 12 has a forward or plug section 14, a rear section 16, latch arms 18, and a plurality of terminal-receiving cavities 20 extending axially therethrough. Conductors 22 have socket terminals 24 terminated on forward ends thereof; wire seals 70 are disposed in enlarged rear portions 26 (shown in FIG. 3) of cavities 20 and sealingly engage around insulated portions of respective conductors 22. Keying ridges 28 extend axially along the peripheral surface 30 of plug section 14. Plug section 14 of housing 12 has an annular groove 32 therearound in peripheral surface 30 thereof, spaced from front surface 34. An annular sealing member 36 is disposed in annular groove 32.

A second connector housing 42 has a forward sleeve-like hood section 44, a rear section 46, latch projections 48, and a plurality of terminal-receiving cavities 50 extending axially therethrough. Conductors 52 have pin terminals 54 terminated on forward ends thereof; wire seals 70 are disposed in enlarged rear portions 56 of cavities 50 and sealingly engage around insulated portions of respective conductors 52. Keying channels (not shown) extend axially along the inner surface of hood section 44 corresponding to keying ridges 28 of mating housing 12. A pair of protective ribs 58 extend axially proximate to but circumferentially spaced from each latch projection 48.

Figure 2:
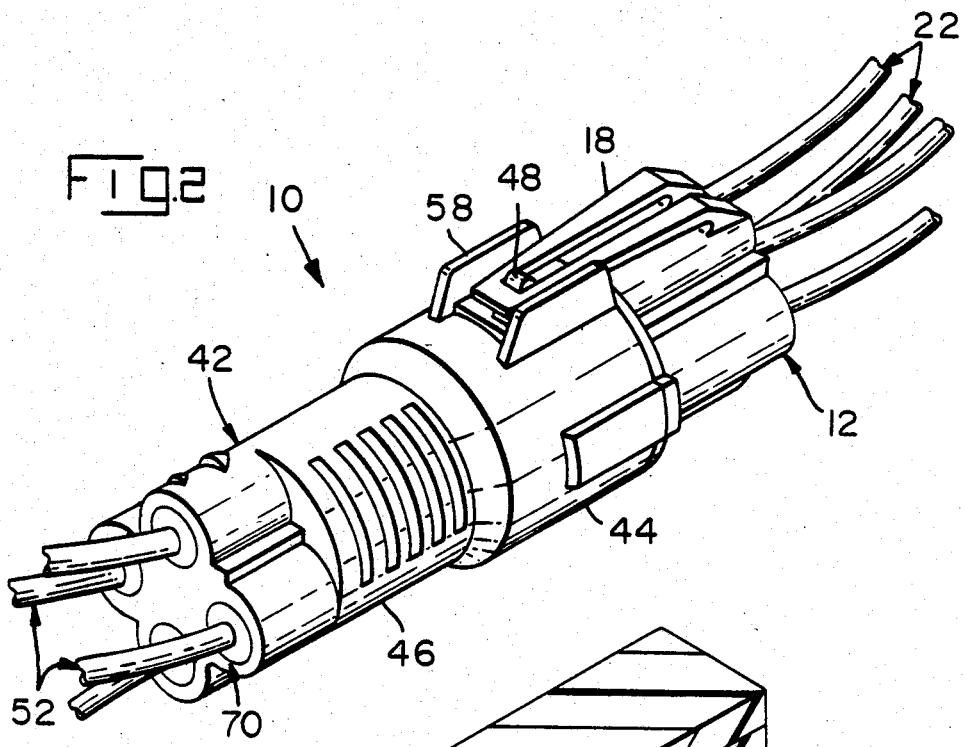
FIG. 2 is a perspective view of the connector assembly of FIG. 1 in assembled condition.

FIG. 2 shows the assembled sealed connector assembly 10 with housing 12 latchingly engaging housing 42, and hood section 44 containing plug section 14 therewithin and the pin and socket terminals electrically engaged therewithin. Terminated conductors 22 and 52 had been secured in respective terminal-receiving cavities 20, 50 of housings 12, 42 prior to mating housings 12 and 42 together. Keying ridges 28 and respective keying channels polarized the housings with respect to each other for appropriate mating. Latch arms 18 are latched behind latch projections 48. Protective ribs 58 protect the latch arms 18 from being inadvertently caught by stray wires. Annular sealing member 36 is deformed to sealingly engage the inner surface of hood section 44 and the bottom surface of groove 32 of plug section 14 thus providing sealing between housings 12 and 42.

Figure 3:
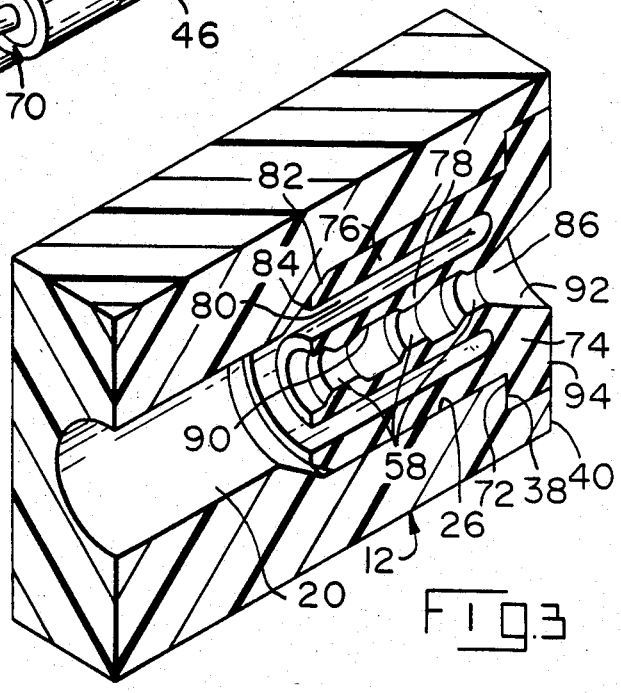
FIG. 3 is a part longitudinal section of the rearward section of a housing with a wire seal of the invention disposed in a terminal-receiving cavity.

A preferred embodiment of wire seal 70 is shown in FIG. 3 in longitudinal section, shown disposed in an enlarged rear portion 26 of terminal-receiving cavity 20 of housing 12, ready to receive a terminated conductor 22 insertably therethrough. Identical wire seals 70 would be similarly disposed in rear cavity portions 56 of housing 42. Annular seal stop section 72 is engaged by cooperating stop surface 38 recessed from rear surface 40 of housing 12 to prevent further axially forward movement of wire seal 70 along rear cavity portion 26. Wire seal 70 comprises a transverse body section 74 forwardly from which extend outer sleeve-like housing-engaging section 76 and inner, tube-like conductor-engaging section 78 which is within outer section 76, substantially coaxial and coextensive therewith. An annular space or gap 80 separates inner section 78 and outer section 76. The outer diameter of outer section 76 is selected to be larger than the inside diameter of enlarged rear cavity portion 26 so that an interference fit exists between outer section 76 and cavity portion 26, which creates a sealing engagement between wire seal 70 and housing 12. A beveled surface 82 is preferably formed around the periphery of front end 84 of outer section 76 to assist in the insertion of wire seal 70 into cavity portion 26.

In FIG. 3 is shown the inside shape of profiled bore 86 which extends forwardly from transverse body section 74 through inner section 78. Three annular ridges 88 extend radially inwardly from the inside surface 90 of inner section 78. Ridges 88 have a reduced diameter selected to be smaller than the diameter of the smallest size conductor wire with which wire seal 70 is intended to be used. The general diameter of profiled bore 86 is selected to be larger than the largest size conductor wire with which wire seal 70 is intended to be used. Transverse body section 74 has a conductor lead-in 92 extending forwardly along profiled bore 86 from rear surface 94 of wire seal 70.

Figure 4A:
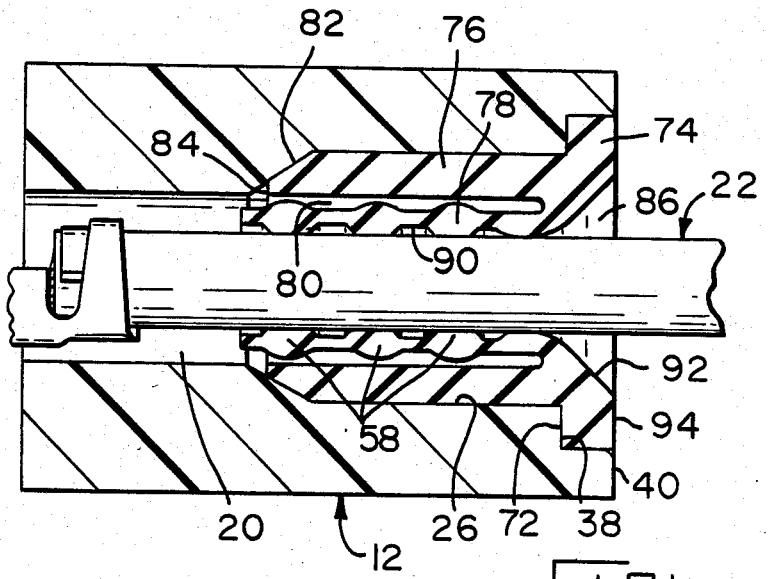
FIGS. 4A and 4B are similar to FIG. 3 wherein the wire seal has a conductor therein having relatively a large diameter and a small diameter respectively.
Figure 4B:
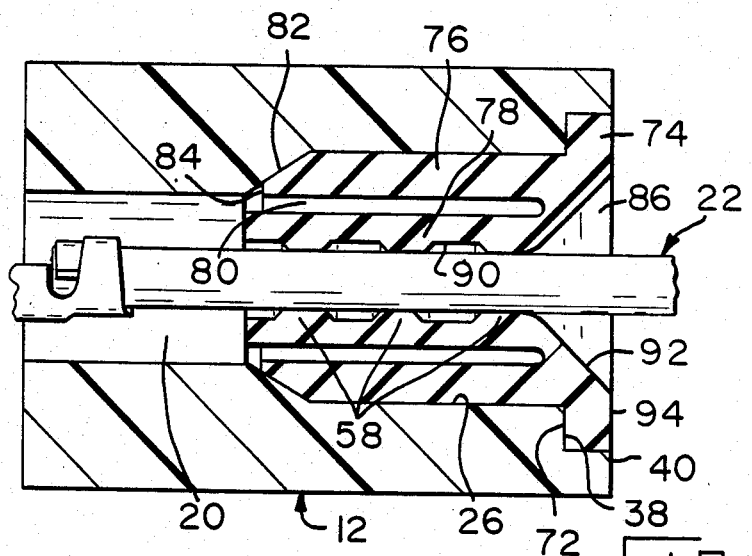

FIGS. 4A and 4B illustrate the use of the wire seal of the present invention with a relatively large conductor wire 22A and a relatively small conductor wire 22B respectively. In FIG. 4A a terminated conductor 22A having a terminal 24A terminated thereon has been inserted into and through wire seal 70A so that terminal 24A has been secured in terminal-receiving cavity 20A by conventional retention means forwardly of wire seal 70A. Large diameter conductor 22A is disposed within profiled bore 86A of wire seal 70A and is engaged by annular ridges 88A. Inner seal section 78 has been deformed radially outwardly at bulges 96A. Because of annular gap 80A, bulges 96A are permitted to deform radially outwardly without engaging outer seal section 76 and without radially outward force being exerted on the sidewalls of cavity portion 26 which would have otherwise generated substantial resistance to the insertion of the terminated conductor 22A through wire seal 70A. Redundant sealing engagement is obtained between inner seal section 78A and conductor 22A at annular ridges 88A.

FIG. 4B illustrates the use of the wire seal of the present invention with a relatively small size conductor. Terminated conductor 22B is disposed along profiled bore 86B of wire seal 70B, its terminal 24B having been secured forwardly thereof in housing cavity 20B. Interference fit is maintained by annular ridges 88B with conductor 22B resulting in some deformation at bulges 96B extending radially outwardly into annular gap 80B. Redundant sealing engagement is obtained between inner seal section 78B and conductor 22B at annular ridges 88B. Thus the same size wire seal can receive and seal against one of several conductors having adjacent wire sizes.

As is understandable from FIGS. 4A and 4B substantial surface contact occurs during the insertion of a terminated conductor 22A, 22B into a wire seal 70A, 70B at annular ridges 88A, 88B, especially since the terminal terminated onto a conductor typically has portions which are wider than the conductor diameter. Beveled surfaces are preferred forwardly and rearwardly of each of ridges 88A, 88B to assist in insertion of conductor 22A, 22B therethrough and to strengthen inner seal section 78A, 78B. To reduce the coefficient of friction resulting from such surface contact, the terminated conductors maybe wiped with alcohol as a lubricant, as is conventional; and after insertion the alcohol easily evaporates.

It is preferable, however, to mold the wire seals of the present invention from a moldable composition which results in the surface portions of wire seals 70 having inherent lubricity which substantially reduces the coefficient of friction. Such a moldable composition based on neoprene is disclosed in U.S. patent application Ser. No. 735,418 filed May 17, 1985. Such inherent lubricity also tends to reduce the possibility of tearing the seal during insertion of the terminated conductor, and to facilitate insertion of the wire seal into the enlarged cavity portion in interference fit.

The wire seal of the present invention especially if molded having inherent lubricity, permits use with conductors of several adjacent wire sizes because of the ability of inner section 78 to be deformed radially outwardly into annular gap 80. Also, annular ridges 88 assure a redundancy of sealing engagement with the conductor, and even if one of the ridges has been torn by a terminal 24, the other ridge or ridges will still provide sealing. Two or four or more such annular ridges may be provided for the wire seal of the present invention; a wire seal of the present invention may also have one ridge although a plurality is preferred.

Other variations and modifications may be made to the wire seal of the present invention, within the spirit of the invention and the scope of the claims.

What is claimed is:

1. A wire sealing means for an electrical conductor having a terminal terminated on the end thereof and securable in a terminal-receiving cavity of an electrical connector housing, comprising an elastomeric wire seal having:

a transverse body section received in said terminal-receiving cavity;

a sleeve-like outer section extending forwardly from said transverse body section and having a preselected outer diameter;

a right cylindrical inner section extending forwardly from said transverse body section substantially coaxial with and located within said outer section and spaced radially inwardly from said outer section defining an annular gap therebetween; and a profiled bore extending forwardly from a rear surface of said wire seal through said transverse body section and said inner section;

said inner section being elastically deformable radially outwardly into said annular gap.

2. A wire sealing means as set forth in claim 1 wherein said profiled bore has a lead-in at said rear surface to receive a said terminated conductor being inserted therethrough.

3. A wire sealing means as set forth in claim 1 wherein said wire seal has an annular stop shoulder therearound proximate said rear surface engageable with a cooperating stop means at a rearward end of said rearward cavity portion of said connector housing to prevent axially forward movement of said wire seal along said rearward cavity portion.

4. A wire sealing means as set forth in claim 1 wherein said wire seal has inherent lubricity.

5. A wire sealing means as set forth in claim 1 wherein at least one annular ridge extends radially inwardly into said profiled bore from said inner section to sealingly engage a said terminated conductor inserted therethrough, and said inner section is deformable radially outwardly thereat by said conductor.

6. A wire sealing means as set forth in claim 5 wherein said inner section has a plurality of said annular ridges providing redundant sealing engagement with said terminated conductor.

7. An electrical connector assembly comprising:

a dielectric housing having at least one terminal-receiving cavity extending axially therethrough and having a rearward cavity portion;

an electrical conductor corresponding to each said terminal-receiving cavity and having an electrical terminal terminated onto an end thereof, each said terminated conductor being insertable and securable in a respective said terminal-receiving cavity from a rear surface of said housing; and an elastomeric wire seal associated with each said terminal-receiving cavity and said corresponding terminated conductor, each said wire seal being securable in a said rearward cavity portion, wherein each said wire seal comprises:

(a) a transverse body section;

(b) a sleeve-like outer section extending forwardly from said transverse body section and having an outer diameter selected to be larger than the inner diameter of said rearward cavity portion such that said outer section sealingly engages sidewalls thereof;

(c) a right cylindrical inner section extending forwardly from said transverse body section substantially coaxial with and located within said outer section and spaced radially inwardly from said outer section defining an annular gap therebetween; and (d) a profiled bore extending forwardly from a rear surface of said wire seal through said transverse body section and said inner section, said inner section being elastically deformable radially outwardly into said annular gap by a said terminated conductor upon insertion through said profiled bore.

8. An electrical connector assembly as set forth in claim 7 wherein at least one annular ridge extends radially inwardly into said profiled bore of each said wire seal from said inner section to sealingly engage said terminated conductor, and said inner section is deformed radially outwardly thereat by said terminated conductor.

9. An electrical connector assembly as set forth in claim 8 wherein each said inner section has a plurality of said annular ridges providing redundant sealing engagement with said terminated conductor.

10. An electrical connector assembly as set forth in claim 7 wherein each said wire seal has an annular stop shoulder therearound proximate said rear surface to engage a cooperating stop means at a rearward end of said rearward cavity portion to prevent axially forward movement of said wire seal along said rearward cavity portion.

11. An electrical connector assembly as set forth in claim 7 wherein each said profiled bore has lead-in at said rear surface to receive said terminated conductor insertably thereinto.

12. An electrical connector assembly as set forth in claim 7 wherein each said wire seal has inherent lubricity.

* * * * *